US007944461B2

(12) United States Patent
Sakurai et al.

(10) Patent No.: US 7,944,461 B2
(45) Date of Patent: May 17, 2011

(54) HEATING DEVICE, ERASING DEVICE, INFORMATION RECORDING AND ERASING DEVICE, AND TRANSFER DEVICE

(75) Inventors: Hideo Sakurai, Shizuoka (JP); Satoshi Arai, Shizuoka (JP); Naoki Yoshida, Tokyo (JP); Tadafumi Tatewaki, Shizuoka (JP)

(73) Assignees: Ricoh Company, Ltd., Tokyo (JP); Wedg Co., Ltd., Tokyo (JP)

( * ) Notice: Subject to any disclaimer, the term of this patent is extended or adjusted under 35 U.S.C. 154(b) by 832 days.

(21) Appl. No.: 11/837,133

(22) Filed: Aug. 10, 2007

(65) Prior Publication Data

US 2008/0062237 A1 Mar. 13, 2008

(30) Foreign Application Priority Data

Sep. 8, 2006 (JP) ..... 2006-244324
Jun. 20, 2007 (JP) ..... 2007-162415

(51) Int. Cl.
*B41J 2/32* (2006.01)

(52) U.S. Cl. ..... 347/200

(58) Field of Classification Search ..... 347/207, 347/200

See application file for complete search history.

(56) References Cited

U.S. PATENT DOCUMENTS 5,021,806 A * 6/1991 Sugiyama ..... 347/207
5,095,318 A * 3/1992 Sugiyama ..... 347/207

FOREIGN PATENT DOCUMENTS

| | | |
|---|---|---|
| EP | 1 260 375 A1 | 11/2002 |
| EP | 1 386 746 A1 | 2/2004 |
| EP | 1 566 275 A1 | 8/2005 |
| JP | 61-123567 | 6/1986 |
| JP | 2-65086 | 3/1990 |
| JP | 4-90588 | 3/1992 |
| JP | 04-345786 | 12/1992 |
| JP | 5-4446 | 1/1993 |
| JP | 6-15856 | 1/1994 |
| JP | 6-255138 | 9/1994 |
| JP | 7-9761 | 1/1995 |
| JP | 7-52545 | 2/1995 |
| JP | 7-282170 | 10/1995 |
| JP | 8-63015 | 3/1996 |
| JP | 8-318634 | 12/1996 |
| JP | 10-44480 | 2/1998 |
| JP | 2002-83671 | 3/2002 |

(Continued)

OTHER PUBLICATIONS

Machine-generated translation of JP 2002-083671, published on Mar. 2002.*

(Continued)

*Primary Examiner* — Huan H Tran
(74) *Attorney, Agent, or Firm* — Oblon, Spivak, McClelland, Maier & Neustadt, L.L.P.

(57) ABSTRACT

A heating device capable of evenly heating a thermal recording medium without increasing the cost of the device is disclosed. The heating device evenly heats the recording surface of a thermally-reversible recording card by conducting the heat energy transferred from a heat generating member by way of a heating member, made of aluminum having high heat conductivity and high heat capacity characteristics. By this feature, it becomes possible to accurately erase the information recorded on the recording card and to use an inexpensive heat generating member as the heat generating member.

13 Claims, 17 Drawing Sheets

FOREIGN PATENT DOCUMENTS

| | | |
|---|---|---|
| JP | 2002-234201 | 8/2002 |
| JP | 2002-337368 | 11/2002 |
| JP | 2003-94699 | 4/2003 |
| JP | 2003-217799 | 7/2003 |
| JP | 2003-317899 | 11/2003 |
| JP | 2004-17572 | 1/2004 |
| JP | 2004-98539 | 4/2004 |
| JP | 3558998 | 5/2004 |
| JP | 2004-160928 | 6/2004 |
| JP | 2004-268256 | 9/2004 |
| JP | 3592634 | 9/2004 |
| JP | 2004-345361 | 12/2004 |
| JP | 2005-59335 | 3/2005 |
| JP | 2005-262850 | 9/2005 |
| JP | 2005-305677 | 11/2005 |
| JP | 3767856 | 2/2006 |
| KR | 1997-0000729 | 1/1997 |

OTHER PUBLICATIONS

Machine-generated translation of JP 07-282170, published on Oct. 1995.*

* cited by examiner

λ : HEAT CONDUCTIVITY

HEATING DEVICE, ERASING DEVICE, INFORMATION RECORDING AND ERASING DEVICE, AND TRANSFER DEVICE

BACKGROUND OF THE INVENTION

1. Field of the Invention

The present invention generally relates to a heating device, an erasing device, an information recording and erasing device, and a transfer device, and more particularly to a heating device heating a thermal medium, an erasing device erasing the information recorded on a thermal recording medium, an information recording and erasing device recording and erasing the information on a thermal recording medium, and a transfer device transferring a coating agent to an object.

2. Description of the Related Art

From the viewpoints of environmental protection and recycling, rewritable papers capable of recording and erasing information repeatedly have attracted attention lately. The rewritable papers typically include a substrate and a thermally-reversible recording layer formed on the substrate by applying leuco dye and oxidizer to the substrate. The recording layer is relatively colored and decolored by heating the recording layer appropriately. To record information on the recording layer, thermal printers having a thermal head to heat the recording media are required. Since the structures of thermal printers are relatively simple and thermal printers can be easily maintained, more and more thermal printers are expected to be used in place of laser printers employing the Carlson process in the future.

This type of thermal printer typically includes an erasing plate and an erasing roller erasing information previously recorded on a recording medium before new information is recorded on the recording medium. Such an erasing plate or the like employs a technique in which a heat accumulating member, having high heat capacity, disposed on the rear surface of the heat generating member is included to compensate the heat amount required in an effective area of a heat generating member to erase recorded information when the recording medium is heated (hereinafter abbreviated to "effective area"), thereby stably maintaining the temperature distribution of the effective area of the heat generating member even when continuous heating of the recording medium is required (see, for example, Patent Document 1). According to the technique described in the Patent Document 1, however, since the heat from a heat generating member is conducted through a protection layer having low heat capacity, it is required that the heating characteristics of the heat generating member itself be even enough to continuously and accurately perform erasing of the information recorded on the recording media, which would be a cause of increasing the cost of the device.

Patent Document 1: Japanese Patent Application Publication No. 2003-317899

SUMMARY OF THE INVENTION

The present invention is made in light of the above-mentioned problem. First, the present invention may provide a heating device capable of heating a thermal medium accurately without increasing the cost of the device.

Second, the present invention may provide an erasing device capable of accurately erasing information recorded on a thermal recording medium.

Third, the present invention may provide an information recording and erasing device capable of recording information to and erasing information on the thermal recording medium accurately.

Fourth, the present invention may provide a transfer device capable of accurately transferring ink to an object.

According to a first aspect of the present invention, there is provided a heating device, heating a thermal medium by heat energy converted from electric energy, including a heat generating member, with a surface thereof coated with an electrical insulator, converting the electric energy to the heat energy; and a heating member substantially evenly conducting the heat energy from the heat generating member.

According to the configuration, heat energy from the heat generating member is conducted to a thermal medium through the heating member to heat the thermal medium. Because of this feature, when a member having high heat capacity is used as the heating member, it is possible that the temperature distribution on the surface where the heating member is in contact with the thermal medium becomes substantially even and the thermal medium is heated evenly regardless of the figure or the temperature distribution of the heat generating member. Therefore, it is possible to accurately heat a thermal medium without using an expensive heat generating member providing an even temperature distribution in the effective range.

According to a second aspect of the present invention, there is provided an erasing device erasing information recorded on a thermal recording medium thermally reversibly colored and decolored, the device including a heating device heating the thermal recording medium to erase the information recorded on the thermal recording medium; and a platen roller moving the thermal recording medium relative to the heating device.

According to the configuration of the erasing device, the information recorded on the thermal recording medium is erased by the heating device of the present invention. Therefore, the thermal recording medium can be heated evenly and accordingly the information recorded on the thermal recording medium can be erased evenly.

According to a third aspect of the present invention, there is provided an information recording and erasing device recording information to and erasing information on a thermal recording medium thermally reversibly colored and decolored, the device including the erasing device heating the thermal recording medium to erase the information recorded on the thermal recording medium; and a recording device recording information on the thermal recording medium whose information has been erased by the erasing device.

According to the configuration, in the erasing device, the information recorded on the thermal recording medium is erased by the heating device of the present invention. Therefore, information recorded on the thermal recording medium can be erased evenly. In the recording device, information is recorded on the thermal recording medium whose information recorded on the thermal recording medium has been evenly erased. Therefore, information can be accurately recorded.

According to a fourth aspect of the present invention, there is provided a transfer device transferring a coating agent applied to one surface of an ink ribbon to an object, the device including a heating device heating the other surface of the ink ribbon to transfer the coating agent to the object; and a platen roller, while pressing the object to the ink ribbon, moving the object relative to the heating device.

According to the configuration, the ribbon can be heated evenly; therefore a coating agent such thermal transfer ink and a overcoat layer applied to the ribbon can be evenly transferred to the object.

DETAILED DESCRIPTION OF THE PREFERRED EMBODIMENTS

Figure 1:
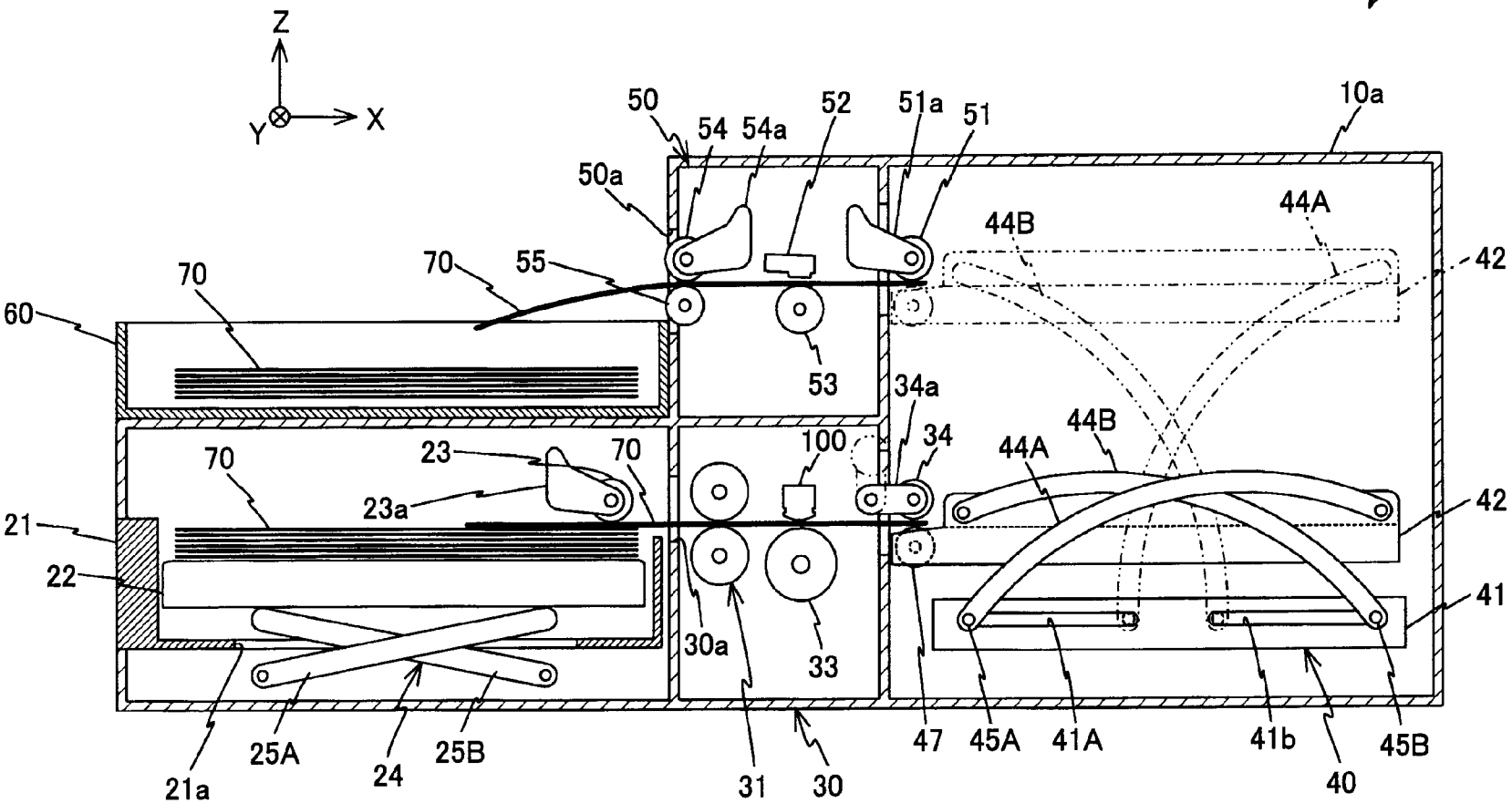
FIG. 1 is a drawing schematically showing a configuration of a printer 10 according to one embodiment of the present invention.

One embodiment of the present invention is described below with reference to the FIGS. 1 through 5. FIG. 1 schematically shows a configuration of a printer 10 according to one embodiment of the present invention. The printer 10 is, for example, a thermal printer capable of erasing and recording information on a recording card 70. As shown in FIG. 1, the printer 10 includes an erasing device 30, a recording device 50, a lifter 40, a paper feed cassette 21, an elevating mechanism 24, a paper feed roller 23, a catch tray 60, and a chassis 10*a* accommodating the above-mentioned parts.

Figure 2:
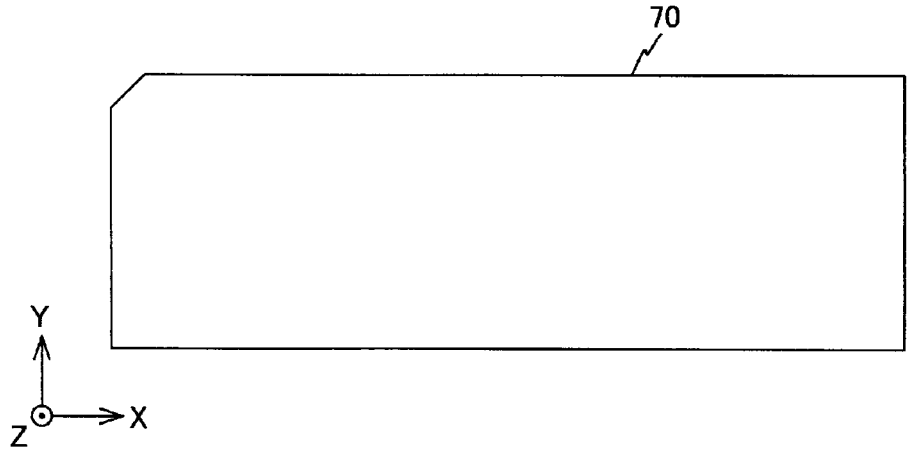
FIG. 2 is a drawing showing a recording card 70.

In the recording card 70, as shown in a plan view of FIG. 2, the longitudinal direction of the recording card is in the X axis direction. The recording card includes a substrate as the base of the card and a recording material applied on the upper side (in the +Z direction) of the substrate.

Figure 3:
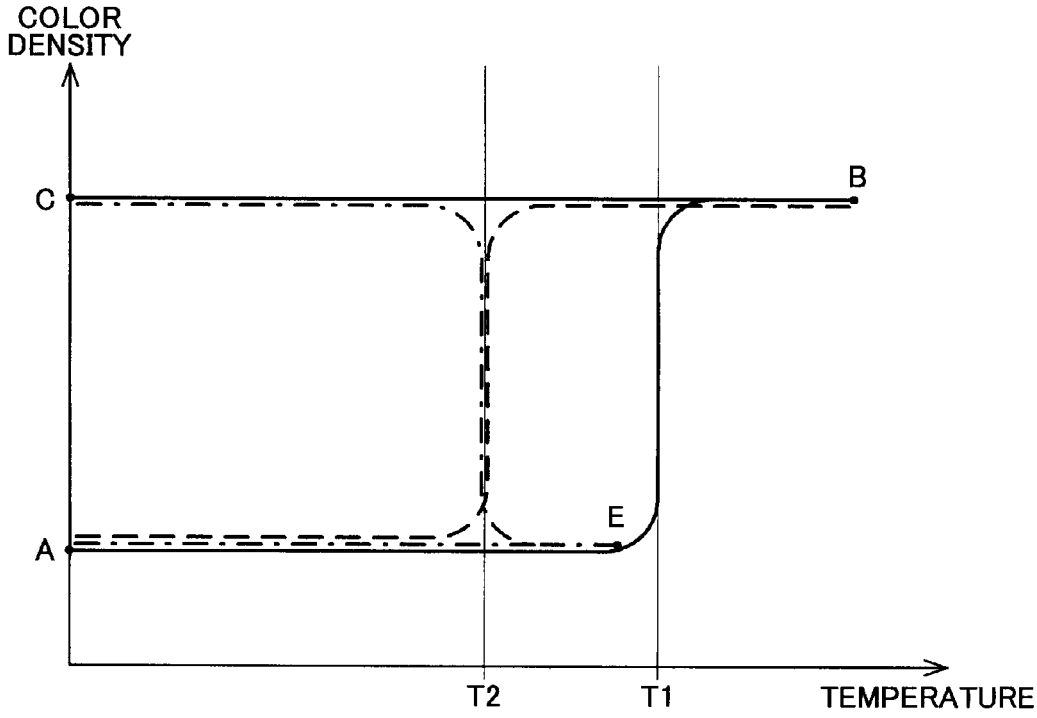
FIG. 3 is a drawing showing thermosensitive characteristics of the recording card 70.

The recording material is a thermally-reversible thermal recording medium capable of being colored and decolored by a thermal head and capable of being relatively colored depending on the heating temperature and the difference in cooling speeds after being heated. As shown in FIG. 3, for example, when the temperature of a thermal recording device is increased from a decolored status A, as shown in the solid line in the graph, coloring of the thermal recording device starts when the temperature approaches near T1 and, when the temperature reaches T1, the thermal recording device is in a colored status B. Then, when the thermal recording device is cooled rapidly from the colored status B, as shown in the solid line in FIG. 3, the colored status is maintained as in colored status C even at room temperature. When the thermal recording medium in status B is cooled gradually, as shown in the dotted line in FIG. 3, decoloring starts during the cooling process to be returned to the decolored status A. On the other hand, when the thermal recording medium in the colored status C is heated again, as shown in the dashed-dotted line in FIG. 3, decoloring starts at temperature T2, which is lower than T1, and the status becomes a decolored status E. When the thermal recording medium in the decolored status E is cooled, the status is returned to the decolored status A. Therefore, information can be erased and recorded by heating the upper surface of the recording card 70 by, for example, a thermal head.

Referring back to FIG. 1, the top of the paper feed cassette 21 is open. There is an opening 21*a* formed on the bottom wall of the paper feed cassette 21. A tray 22 movable in the Z axis direction is provided in the paper feed cassette 21. In the tray 22, the above-mentioned recording cards 70 are stacked with the longitudinal direction of the recording cards set in the X axis direction. When the paper feed cassette 21 is inserted into the chassis 10*a*, the tray 22 is lifted up by an elevating mechanism 24 extending through the opening 21*a* of the paper feed cassette 21. The elevating mechanism 24 has a pair of stick-shaped members 25A and 25B provided so as to rotate around the axes parallel to the Y axis and passing through, for example, the ends of −X and +X sides. By this feature, a recording card 70 at the top of the recording cards 70 stacked in the tray 22 is pressed downward by the lower surface of the paper feed roller 23 held by a holding member 23*a*. When the paper feed roller rotates, the recording card 70 is fed inside the erasing device 30 through the insertion opening 30*a*.

The erasing device 30 includes a pair of feed roller 31 feeding the recording cards 70 sequentially from the paper feed cassette 21 in the +X direction, a heating device 100 as an erase head disposed on the +X side from the feeding rollers 31 and capable of ascending and descending, a platen roller 33 disposed below the heating device 100, and a movable roller 34 disposed, in the +X direction of the heating device 100, by way of a movable member 34*a*.

Figure 4:
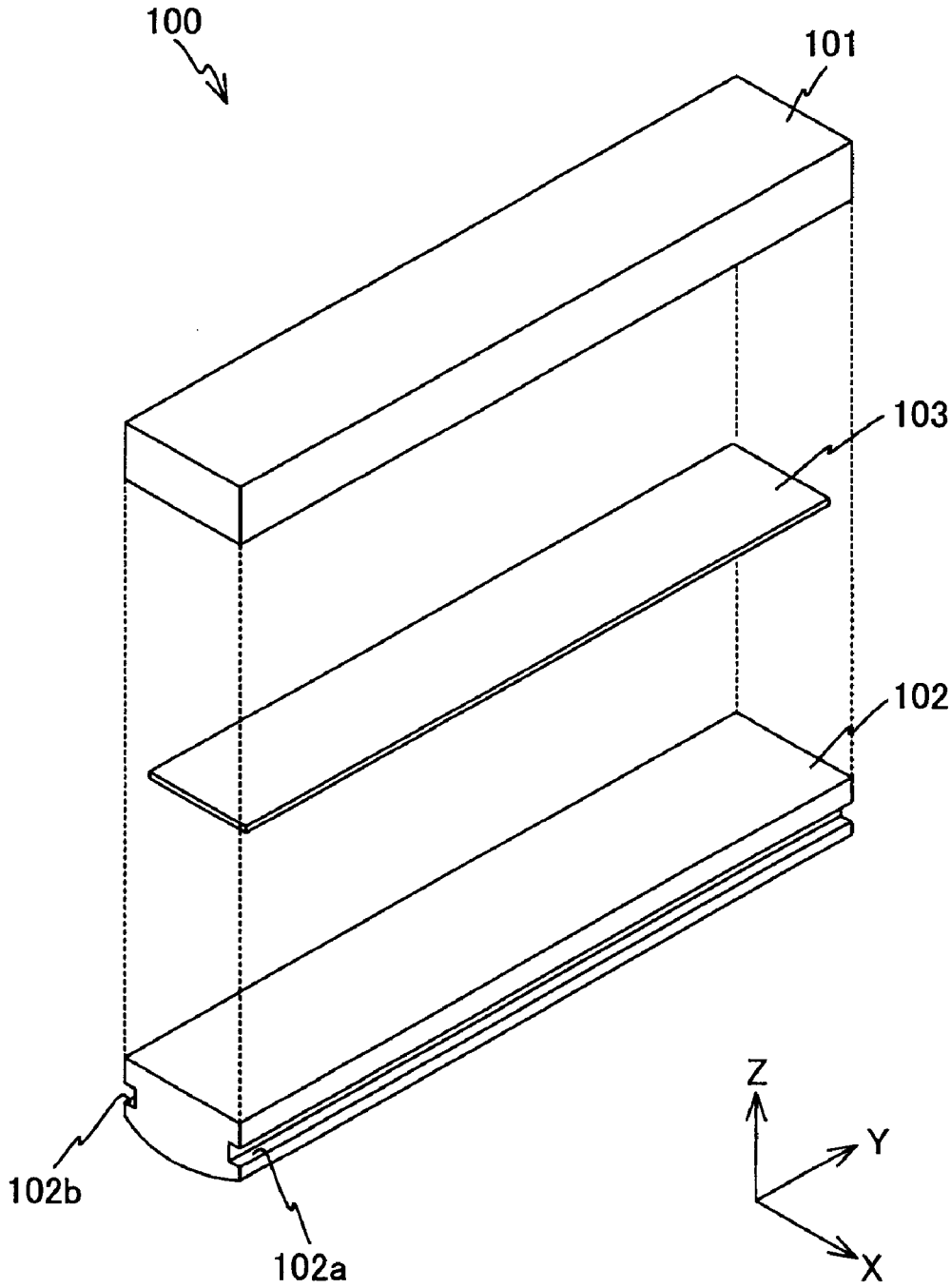
FIG. 4 is an exploded perspective view of a heating device 100.

FIG. 4 is an exploded perspective view of the heating device 100. As shown in FIG. 4, the heating device 100 includes a heat generating member 103 generating heat from power supplied externally, and a heat accumulating member 101 and a heating member 102 that are disposed on the upper and lower sides, respectively, of the heat generating member 103.

Figure 5:
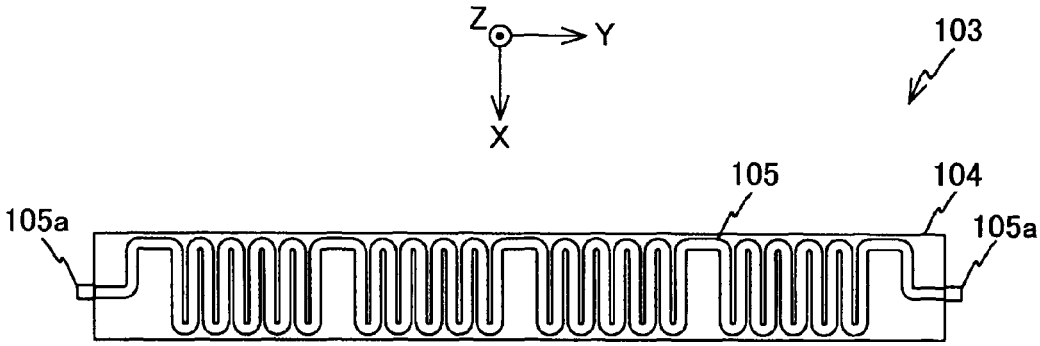
FIG. 5 is a drawing showing a heat generating member 103.

The heat generating member 103 is sheet-shaped with the longitudinal direction in the Y axis direction, and as shown in FIG. 5, includes a resistor 105 made by punching out or etching stainless foil several microns in thickness, and a pair of polymide sheets 104 one applied on each of the upper and lower surfaces of the resistor 105 with the longitudinal direction of the resistor 105 set in the Y axis direction. A pair of electrodes 105*a* are formed on each of +Y and −Y ends of the resistor 105. A main body of the resistor 105 between the two electrodes meanders in the X direction, thereby securing an area from which a prescribed amount of heat energy is transferred ("an effective area") and adjusted so that the resistivity per unit length is constant over the entire resistor 105 by forming the resistor 105 so that the width of the heat generating member 103 is constant. The upper and lower surfaces of the resistor 105 are electrically insulated by applying polyimide sheets on each of the surfaces.

The heat accumulating member 101 is rectangular-shaped with the longitudinal direction in the Y axis direction. As a material of the heat accumulating member 101, for example, aluminum as a metal having high heat conductivity may be used. However, gold, silver, copper, and ferrum may also be used as long as it is a metal having high heat conductivity.

The heating member 102 is rectangular-shaped with the longitudinal direction in the Y direction. Grooves 102*a* and 102*b* are formed on the +X and −X side surfaces, respectively, of the heating member 102 along the Y axis. The bottom surface of the heating member 102 is curved downward having a bus line parallel to the Y axis. Like the heat accumulating member 101, aluminum is used as a material of the heating member 102, and the heat capacity of the heating member 102 is adjusted so as to be substantially equal to the heat capacity of the heat accumulating member 101. It should be noted that the heat conductivity of the heating member 102 should be high and the heat capacity of the heating member 102 should be substantially equal to the heat capacity of the heat accumulating member 101. But, it is not required that the materials of the heating member 102 and the heating accumulating member 101 be the same.

The above-mentioned heat generating member 103, heat accumulating member 101, and heating member 102 are integrated in such a manner that the heat generating member 103 is sandwiched between the heat accumulating member 101 and the heating member 102 from upper and lower directions, respectively, fixed together with, for example, bolts. It should be noted that when the heat generating member 103 is sandwiched between the heat accumulating member 101 and the heating member 102, a filling agent such as grease having high heat conductivity may be applied on both sides of the heat generating member 103, thereby increasing the heat conductivity between the heat generating member 103 and the heat accumulating member 101 and between the heat generating member 103 and the heating member 102.

When the recording card 70 is fed into the erasing device 30, while the recording card 70 is being conveyed in the +X direction, the heating surface of the heating device 100 is set so as to contact with the upper surface of the recording card 70 sustained from beneath by the platen roller 33. The information recorded on the recording card 70 is erased by heating the upper surface of the recording card 70 up to or more than the temperature T2 shown in FIG. 3 by supplying power to the resistor 105 of the heating device 100 through the electrodes 105*a*.

The recording device 50 is disposed on the upper side (in the +Z direction) of the erasing device 30 and includes a recording head 52 held by a holding member (not shown) capable of ascending and descending, a platen roller 53 disposed beneath the recording head 52, a pull-in roller 51 disposed in the +X direction of the recording head 52 and pulling the recording card 70 conveyed by way of the lifter 40 in between the recording head 52 and the platen roller 53, and first and second feed out rollers 54 and 55 disposed on upper and lower sides, respectively, in the −X direction of the recording head 52.

In the recording device 50, when the −X side of the recording card 70 is pulled in between the recording head 52 and the platen roller 53, while the recording head 52 is being set to contact with the upper surface of the recording card 70 sustained from beneath by the platen roller 53, the recording card 70 is fed in the −X direction by the platen roller 53, and the information is recorded by heating the upper surface of the recording card 70 at more than the temperature T1. On the other hand, the pull-in roller 51 and the first feed-out roller 54 are disposed by way of holding members 51*a* and 54*a*, respectively, capable of being raised and lowered by corresponding driving mechanisms (not shown), thereby retracting the pull-in roller 51 and the first feed-out roller 54 so as not to interfere when information is being recorded on the recording card 70. When the recording is completed, the recording card 70 is sandwiched between the first and the second feed-out rollers 54 and 55, respectively, by contacting the first feed-out roller 54 with the upper surface of the recording card 70 and the recording cards 70 are sequentially fed out to the catch tray 60 through the feed-out opening 50*a*, formed on the chassis 10*a*, by rotating the second feed-out roller 55.

The lifter 40 includes an elevating mechanism 41 disposed in the +X direction of the erasing device 30 in the chassis 10*a*, a feeding tray 42 connected to the elevating mechanism 41 by way of link bars 44A and 44B, and a feed in/out roller 47 disposed near the end of the −X side of the feeding tray 42 with the longitudinal direction of the roller 47 in the Y axis direction.

The elevating mechanism 41 is disposed above the bottom surface of the chassis 10*a* held by a holding member (not shown) with the longitudinal direction of the elevating mechanism 41 in the X axis direction. The elevating mechanism 41 includes elongated guide holes 41*a* and 41*b* formed from the −X end and the +X end, respectively, to the middle of the mechanism with the longitudinal direction of the elongated holes 41*a* and 41*b* in the X direction, and movable axles 45A and 45B movable along the elongated guide holes 41*a* and 41*b*, respectively.

The link bar 44A has an upwardly curved shape, with the +X end of the link bar connected with the upper +X side of the feeding tray 42 so as to move rotationally with respect to an axis parallel to the Y axis, and with the −X end of the link bar connected with the movable axle 45A provided on the elevating mechanism 41 so as to move rotationally with respect to an axis parallel to the Y axis. The link bar 44B, similar to the configuration of the link bar 44A, has an upwardly curved shape, with the −X end of the link bar connected with the upper −X side of the feeding tray 42 so as to move rotationally with respect to an axis parallel to the Y axis, and with the +X end of the link bar connected with the movable axle 45B provided on the elevating mechanism 41 so as to move rotationally with respect to an axis parallel to the Y axis.

The lifter 40 is designed to move the feeding tray 42 downward by moving the movable axle 45A in the −X direction and moving the movable axle 45B in the +X direction to position the tray at the position shown in solid lines in FIG. 1 and to move the feeding tray 42 upward by moving the movable axle 45A in the +X direction and moving the movable axle 45B in the −X direction to position the tray at the position shown in phantom lines in FIG. 1. In this description, for explanation purposes, the positions of the feeding tray 42 shown in the solid lines and phantoms lines in FIG. 1 are defined as a "feed-in position" and "feed-out position", respectively.

Next, the operations of the printer 10 having above-mentioned configuration are described. In the description, it is assumed that there are plural recording cards 70 previously accommodated in the paper feeding cassette 21, the tray 22 is already moved up by the elevating mechanism 24, the feeding tray 42 is positioned at the position shown in the solid lines in FIG. 1, and each part of the printer is under overall control of a controlling device (not shown).

<<Paper Feeding Step>>

The controlling device, upon receiving an operational instruction from a user or a higher-level device, controls so that the paper feed roller 23 is rotated to feed a recording card 70, accommodated in the paper feed cassette 21, in the +X direction. As a result, the recording card 70 is fed between the pair of feed rollers 31 in the erasing device 30 through the insertion opening 30*a*.

<<Erasing Step>>

When the recording card 70 is fed in the erasing device 30, the controlling device controls so that, while the recording card 70 is being fed in the +X direction by the pair of feed rollers 31 and platen roller 33, the heating device 100 heats the upper surface of the recording card 70 to erase the information recorded on the recording card 70.

<<Feeding in Step to Lifter>>

When the recording card 70 is fed in the +X direction and the +X end of the card passes above the feed in/out roller 47 provided in the feeding tray 42, the controlling device causes the movable member 34*a* to be rotated so that the movable roller 34 contacts with the upper surface of the recording card 70 and the recording card 70 is fed into the feeding tray 42 by jointly rotating the movable roller 34 and the feed in/out roller 47.

<<Lifting Up Step>>

When the recording card 70 is fed into the feeding tray 42, the controlling device drives the elevating mechanism 41 to start moving the feeding tray 42 upward. In a printer 10 according to the embodiment of the present invention, the time period necessary for the feeding tray 42 to move from the feed-in position to the feed-out position is approximately 1 to 2 seconds.

<<Feeding Out Step from Lifter>>

When the feeding tray 42 is positioned at the feed-out position, the controlling device drives the holding member 51*a* so that the pull-in roller 51 contacts with the upper surface of the recording card 70, and feeds the −X end of the recording card 70 to the position between the recording head 52 and the platen roller 53 by jointly rotating the pull-in roller 51 and the feed in/out roller 47.

<<Recording Step>>

When the recording card 70 is fed in the −X direction and the record starting position of the recording card 70 reaches beneath the recording head 52, the controlling device moves the recording head 52 downward so that the recording card 70 is sandwiched between the recording head 52 and the platen roller 53 and moves the pull-in roller 51 and the first feed-out roller 54 to the position where no interference occurs with respect to the recording card 70 by moving the holding members 51*a* and 54*a* upward. The controlling device controls so that the recording card 70 is moved relative to the recording head 52 only by driving the platen roller 53 to start recording information on the recording card 70. In parallel with the operations, when the recording information on the recording card 70 is started, the controlling device moves the feeding tray 42 to the feed-in position and puts the tray on stand-by.

<<Paper Feeding Out Step>>

Then, after the recording of the information is completed, the recording card 70 is fed out through the feed-out opening 50*a* by the first and the second feed-out rollers 54 and 55, respectively, and is sequentially stacked in the catch tray 60.

As described above, according to the embodiment of the present invention, when the heating device 100 heats the recording card 70, first, heat from the heat generating member 103 is conducted to the heating member 102. In this embodiment of the present invention, since the heating member 102 is made of aluminum having high heat conductivity, the temperature distribution on the heated surface of the heating member 102 is evened regardless of the figure and the heat distribution of the resistor 105. As a result, a recording surface of the recording card 70 can be evenly heated. Because of this feature, the heating device 100 according to the embodiment of the present invention enables even heating of the recording surface of the recording card 70 and accurate erasing of the information recorded on the recording card 70.

Figure 7:
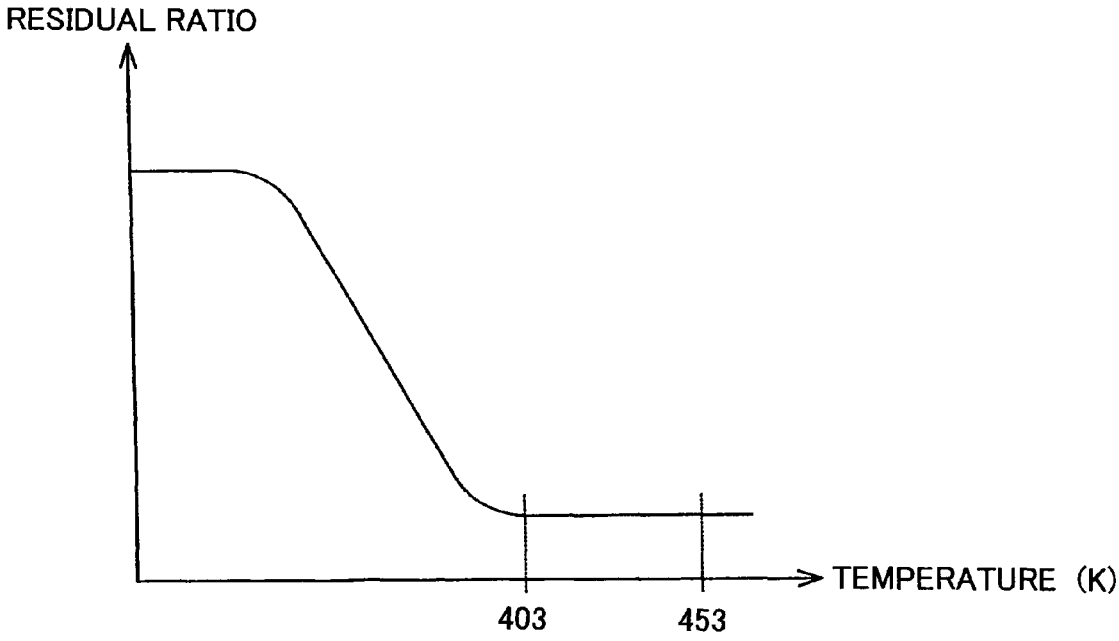
FIG. 7 is a drawing showing an appropriate heating temperature when information on the recording medium is being erased.

FIG. 7 shows erasing characteristics of the recording card 70. The erasing characteristics shows the temperature-dependent residual ratio of residual (not erased) information amount to all the information amount when the recording card 70 is moved at a speed of 150 mm/sec relative to the heating device 100. It should be noted when the information on the recording card 70 having such erasing characteristics is erased, as shown in FIG. 7, it is required, for example, to heat the recording card 70 at a temperature of 403 K through 453 K where the residual ratio of the information on the recording surface of the recording card 70 is minimized.

Figure 8:
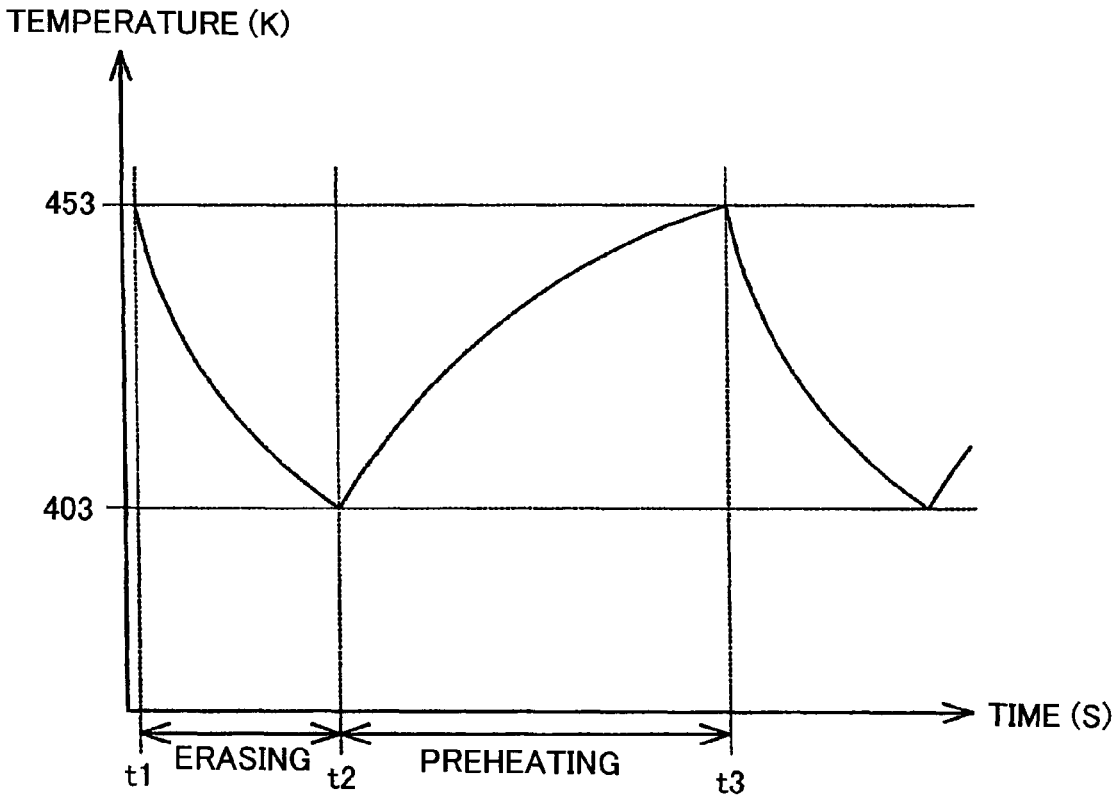
FIG. 8 is a drawing showing a temperature fluctuation range of each part of the heating device 100.

FIG. 8 shows the temperature fluctuation of the heating member 102 when the information on the recording card 70 is being erased from time t1 to t2 and preheating the heating device 100 from time t2 to t3; this cycle is repeated to erase the information on the recording card 70. As shown in FIG. 8, in the heating device 100, when erasing the information, the temperature of the heating member 102 is decreased since the heat is transferred to the recording card 70 to erase the information on the recording card 70. However, as described above, when the temperature of the heating member 102 becomes lower than 403 K, the information on the recording card 70 cannot be erased well. Because of this feature, in the heating device 100 according to the embodiments of the present invention, the temperature of the heating member 102 is always required to be kept in a range of 403 K through 453 K by inserting a prescribed preheating period between erasing periods so as to continuously erase the information on the recording card 70.

Figure 9:
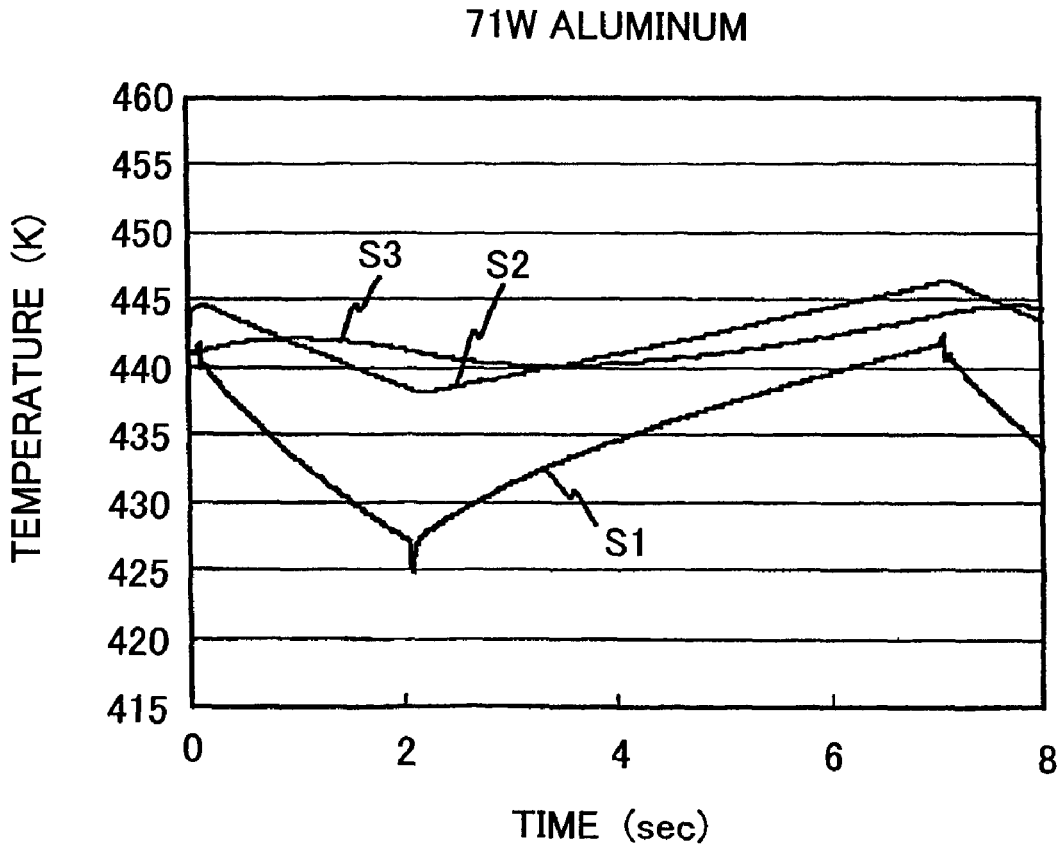
FIG. 9 is a drawing showing a simulation result of the temperature fluctuation of each part of the heating device 100.
Figure 10A:
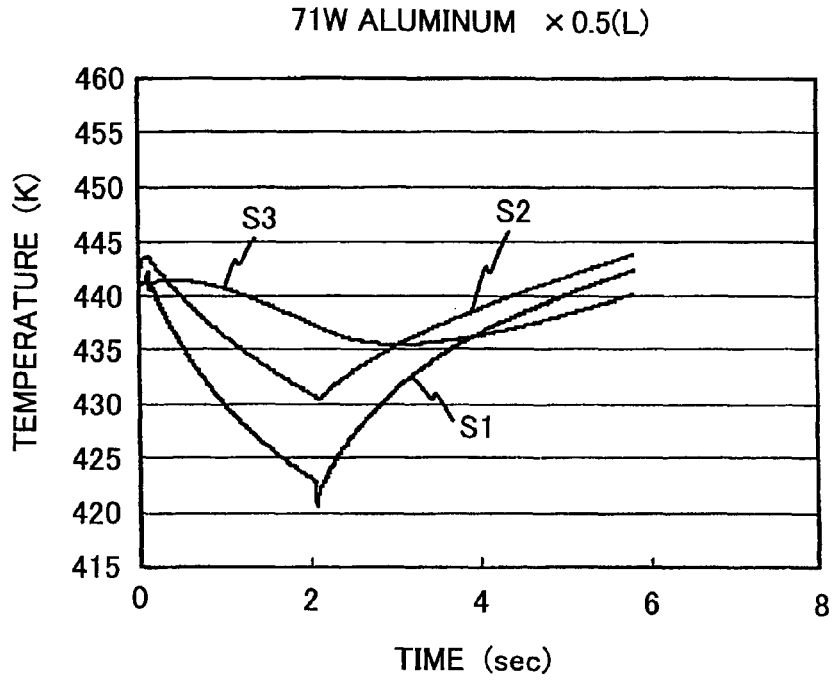
FIGS. 10A and 10B are drawings showing a simulation result of the temperature fluctuation depending on the thicknesses of the heat accumulating member 101 and the heating member 102 of the heating device 100 (No. 1 and No. 2, respectively)
Figure 10B:
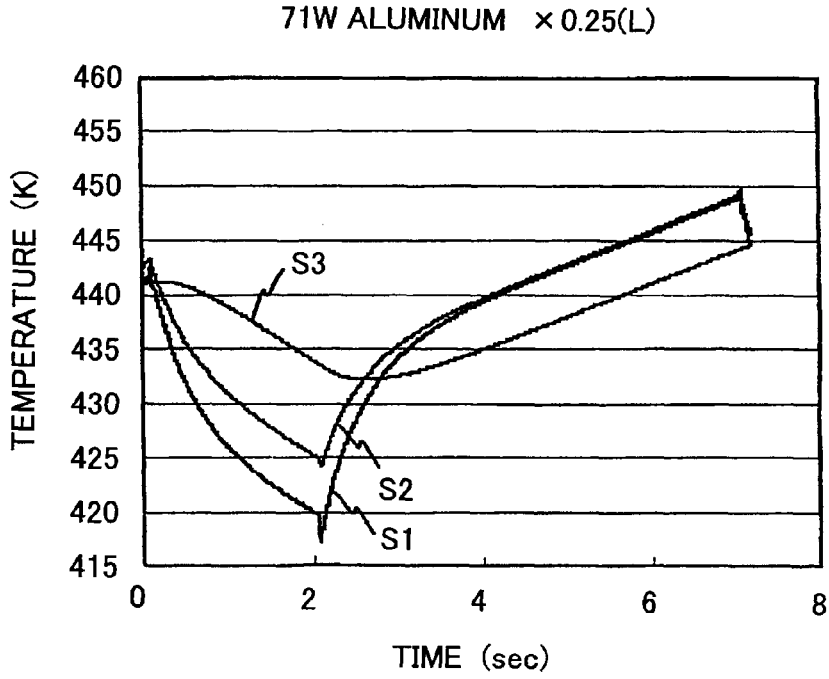
Figure 11A:
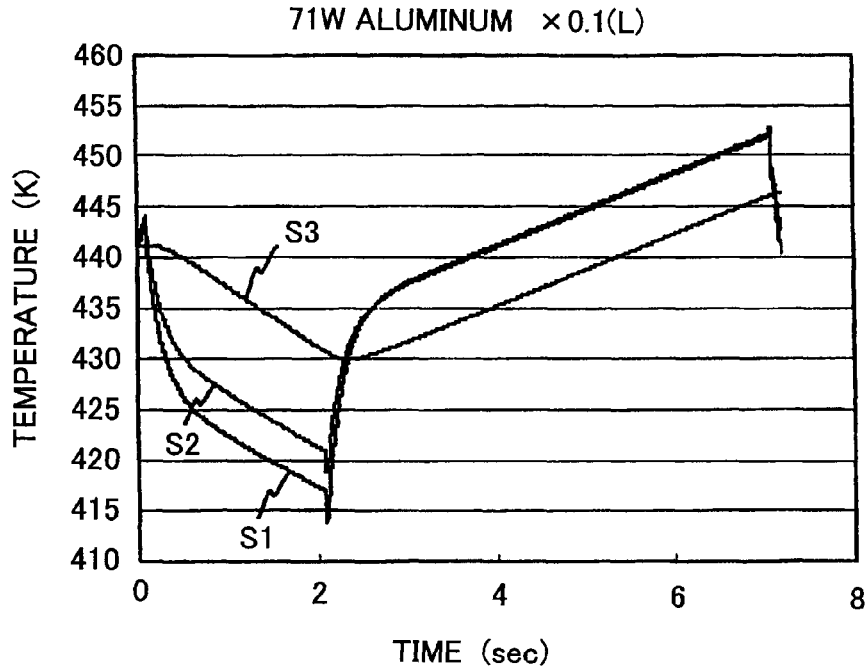
FIGS. 11A and 11B are drawings showing a simulation result of the temperature fluctuation depending on the thicknesses of the heat accumulating member 101 and the heating member 102 of the heating device 100 (No. 3 and No. 4, respectively)
Figure 11B:
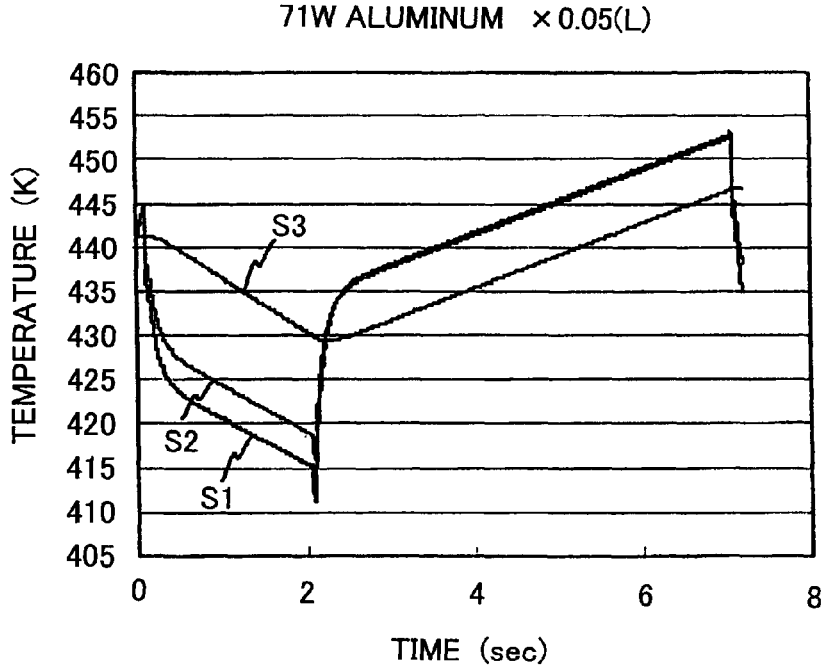
Figure 12A:
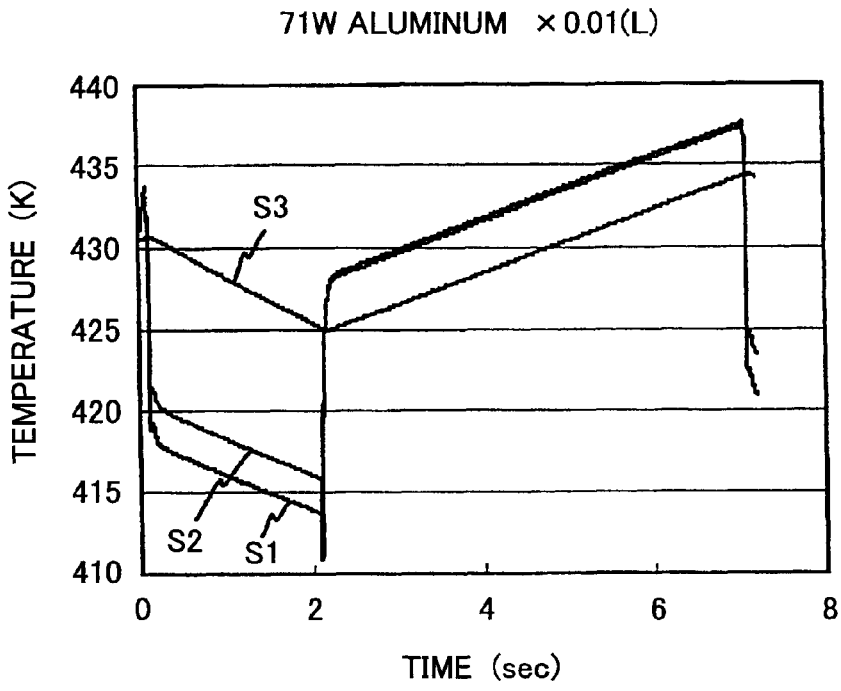
FIGS. 12A and 12B are drawings showing a simulation result of the temperature fluctuation depending on the thicknesses of the heat accumulating member 101 and the heating member 102 of the heating device 100 (No. 5 and No. 6, respectively)
Figure 12B:
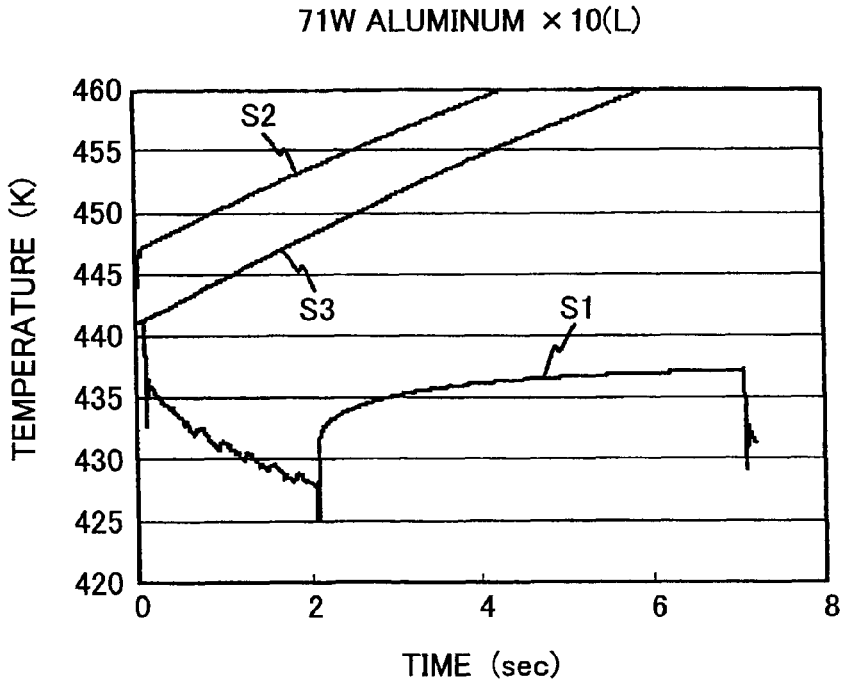

FIG. 9 shows the temperature fluctuation of each part of the heating member 100 when the information on the recording card 70 is being erased using the heating device 100 according to the embodiments of the present invention. That is, curved lines S1, S2 and S3 indicate the temperature fluctuations of the heating member 102, the heat generating member 103, and the heat accumulating member 101, respectively.

In this case, the sizes of the heat accumulating member 101, the heating member 102, and the heat generating member 103 are provided as shown in the Table 1 below. The size in the X axis direction of the recording card is 300 mm (assumed A4-size paper), another recording card 70 is moved at a speed of 150 mm/s relative to the heating device 100, the recording card 70 is provided approximately every 7 seconds, and the applied power to the heat generating member is 71 W.

TABLE 1

| MEMBER | SIZE IN X DIRECTION | SIZE IN Y DIRECTION | SIZE IN Z DIRECTION |
|---|---|---|---|
| HEAT ACCUMULATING MEMBER | 12 mm | 100 mm | 5.50 mm |
| HEAT GENERATING MEMBER | 12 mm | 100 mm | 5.50 mm |
| HEATING MEMBER | 12 mm | 100 mm | 5.50 mm |

As shown in FIG. 9, in the heating device according to the embodiment of the present invention, since the temperature of the heating member 102 is kept to be 403 K or more, it is possible to continuously erase the information on the recording card 70.

Further, as shown in FIG. 9, in the heating device according to the embodiment of the present invention, the temperature of the heat accumulating member 101 does not change as greatly as the temperature of the heating member 102. Therefore, simulations are performed to examine how the temperature changes when the thicknesses of the heat accumulating member 101 and the heating member 102 are changed.

Figure 13A:
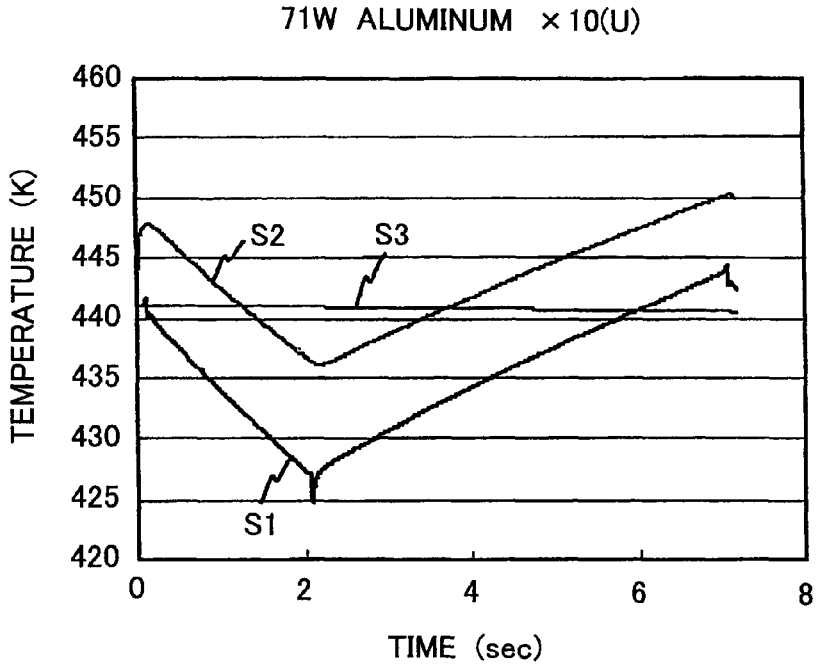
FIGS. 13A and 13B are drawings showing a simulation result of the temperature fluctuation depending on the thicknesses of the heat accumulating member 101 and the heating member 102 of the heating device 100 (No. 7 and No. 8, respectively)
Figure 13B:
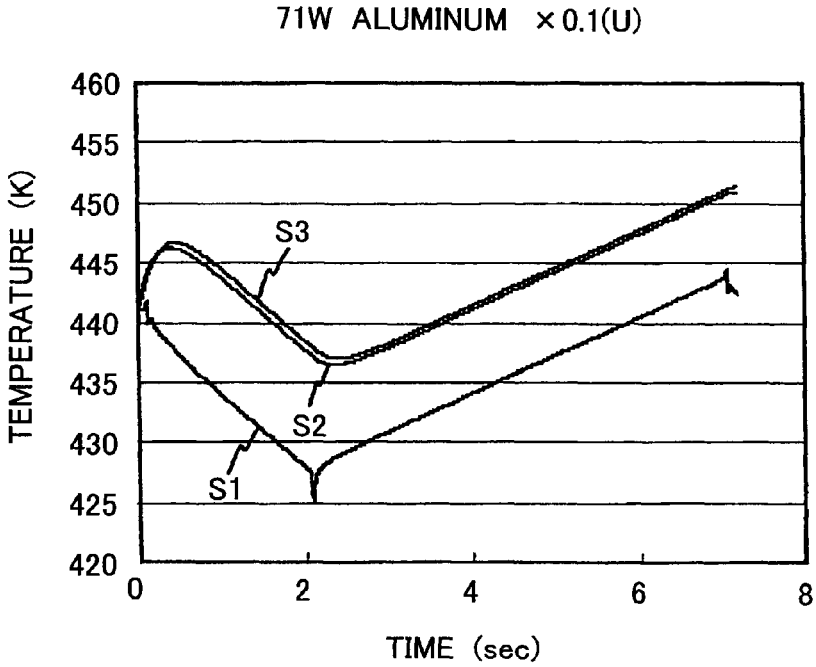
Figure 14:
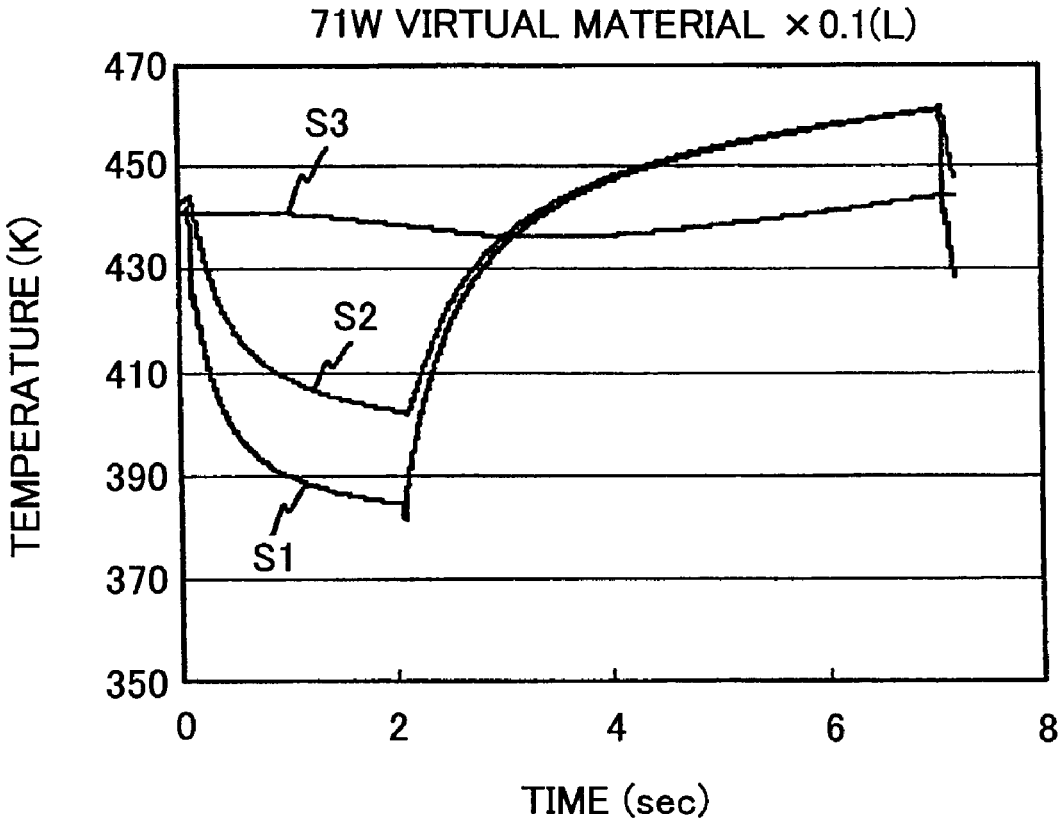
FIG. 14 is drawings showing a simulation result of the temperature fluctuation depending on the thicknesses of the heat accumulating member 101 and the heating member 102 of the heating device 100 (No. 9)
Figure 15A:
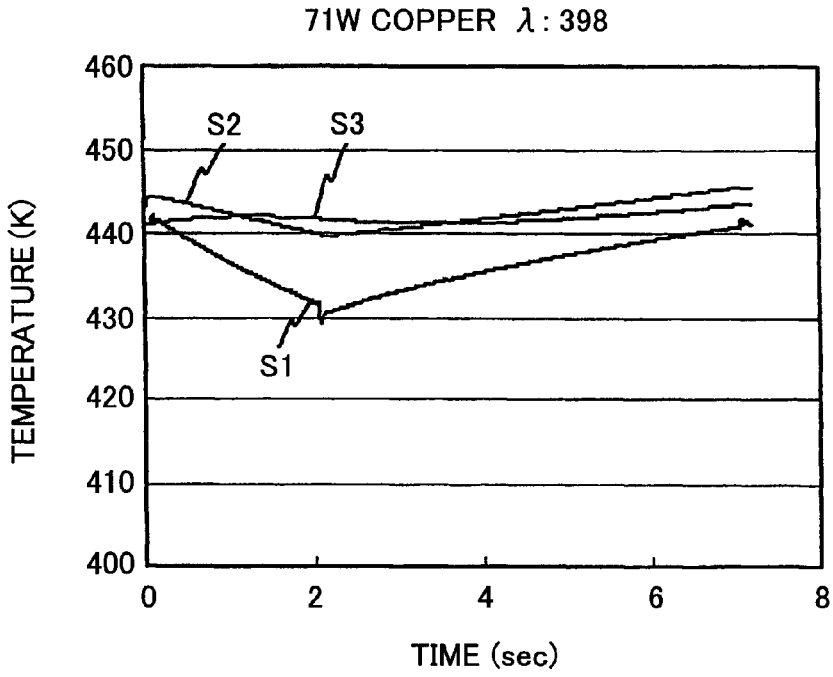
FIGS. 15A and 15B are drawings showing a simulation result of the temperature fluctuation depending on heat conductivity of the heat accumulating member 101 and the heating member 102 of the heating device 100 (No. 1 and No. 2, respectively)
Figure 15B:
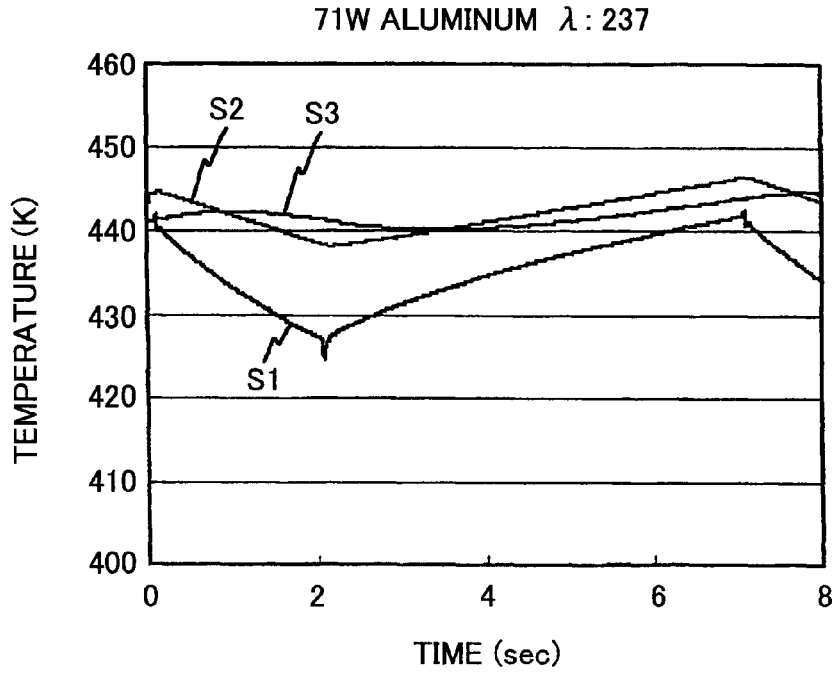
Figure 16A:
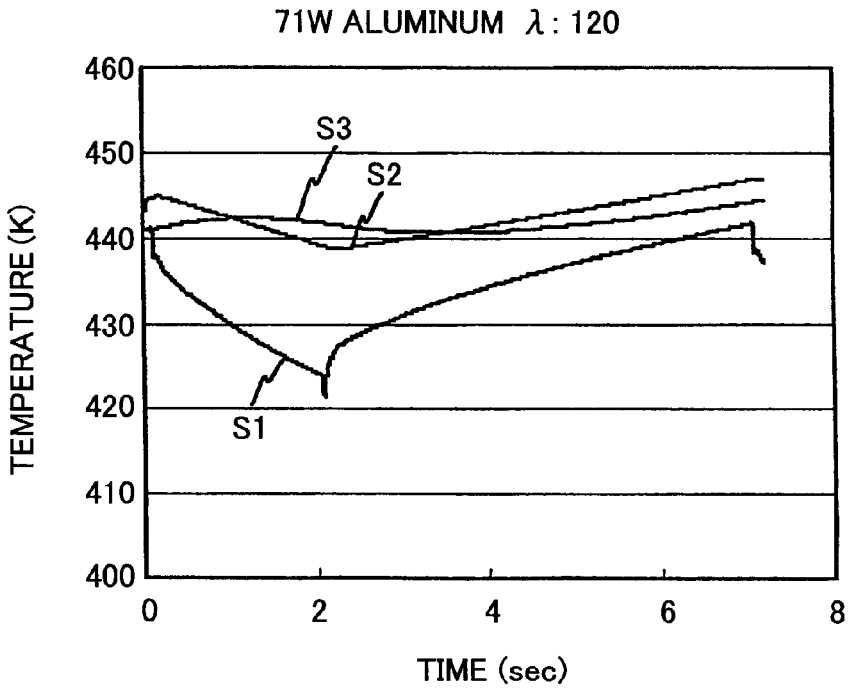
FIGS. 16A and 16B are drawings showing a simulation result of the temperature fluctuation depending on heat conductivity of the heat accumulating member 101 and the heating member 102 of the heating device 100 (No. 3 and No. 4, respectively)
Figure 16B:
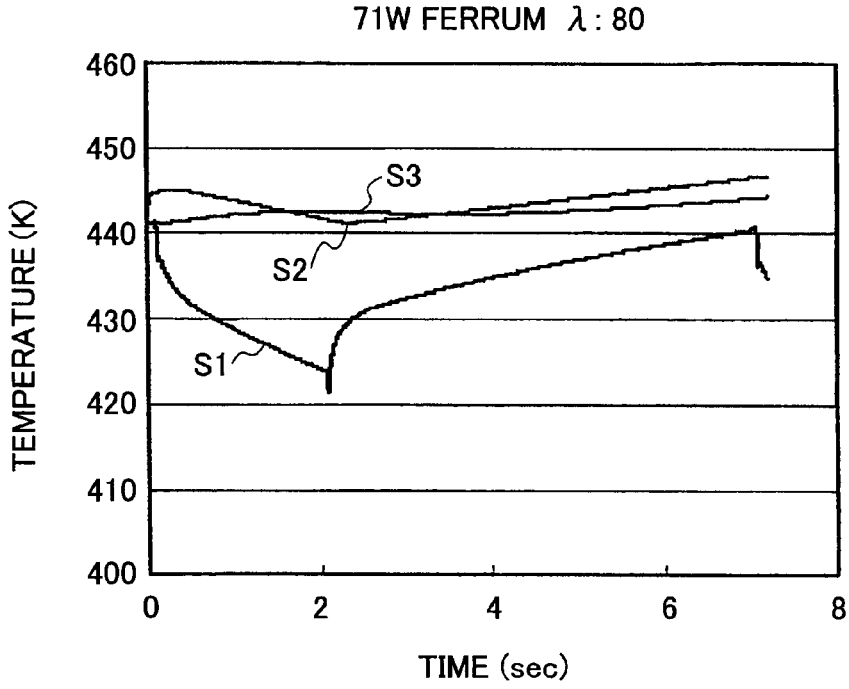
Figure 17A:
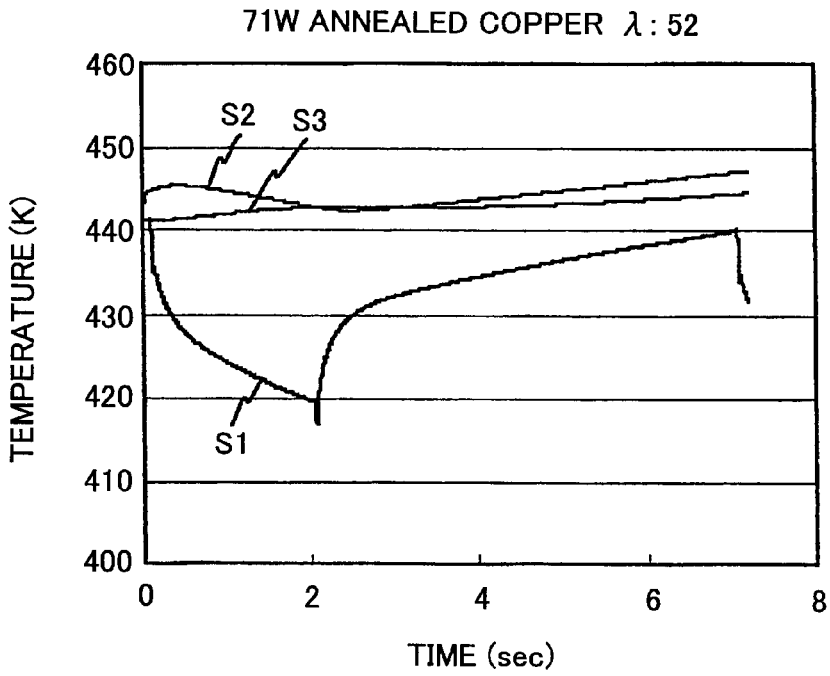
FIGS. 17A and 17B are drawings showing a simulation result of the temperature fluctuation depending on heat conductivity of the heat accumulating member 101 and the heating member 102 of the heating device 100 (No. 5 and No. 6, respectively)
Figure 17B:
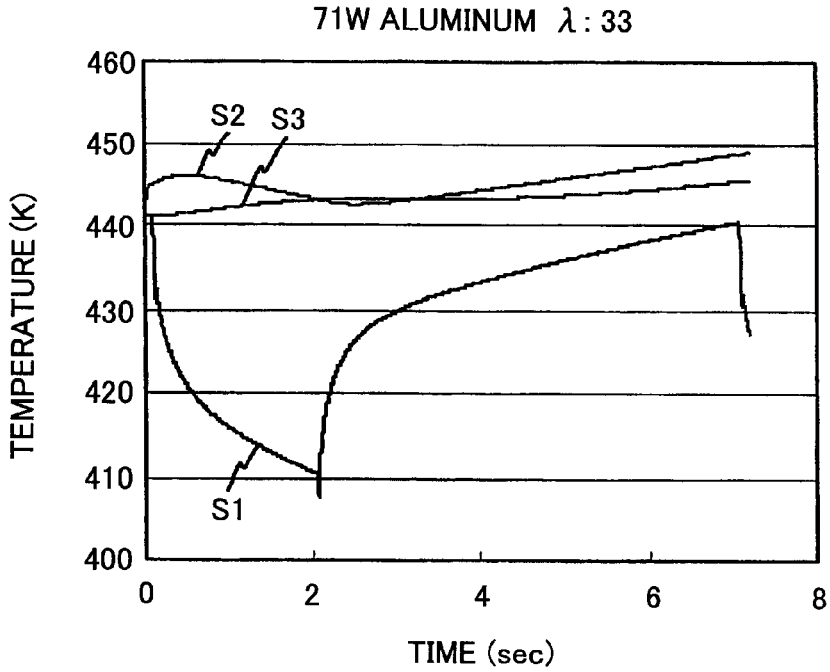
Figure 18A:
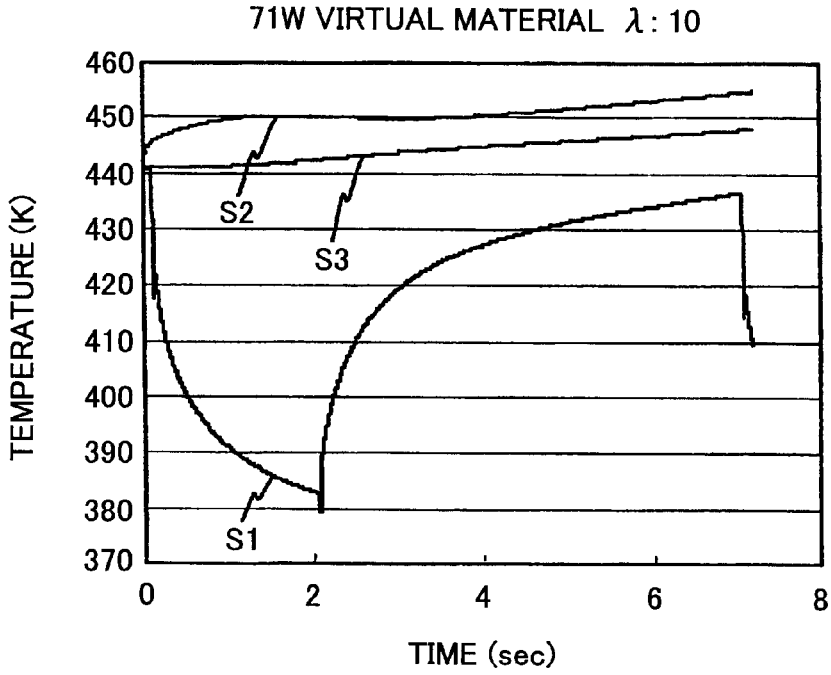
FIGS. 18A and 18B are drawings showing a simulation result of the temperature fluctuation depending on heat conductivity of the heat accumulating member 101 and the heating member 102 of the heating device 100 (No. 7 and No. 8, respectively)
Figure 18B:
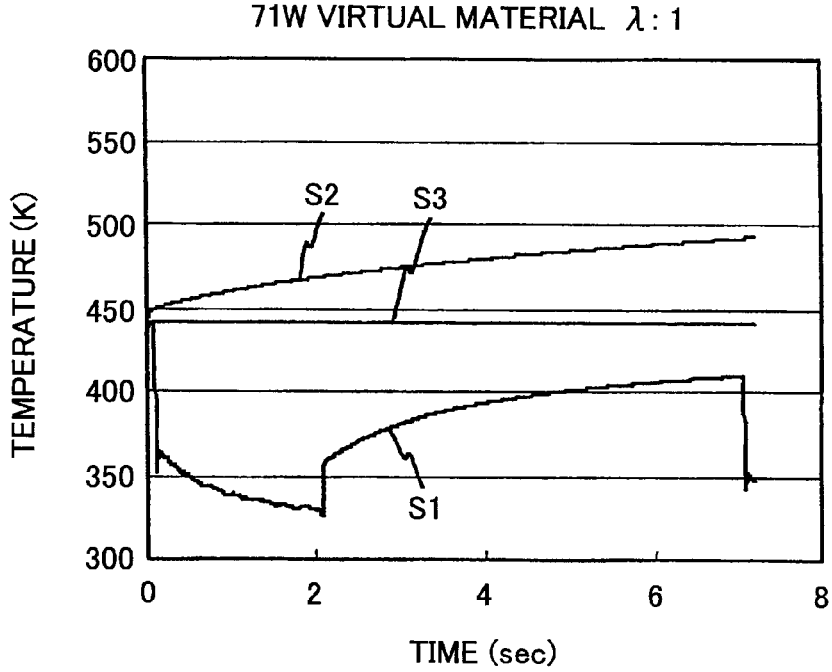
Figure 19:
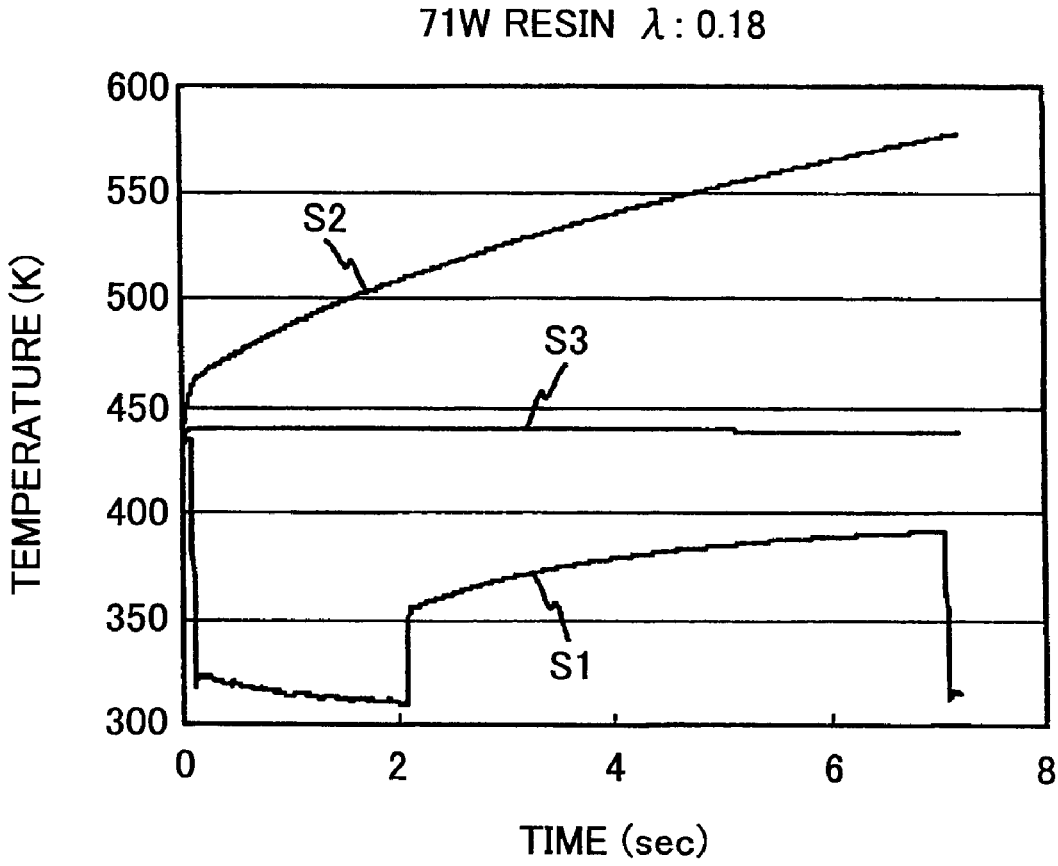
FIG. 19 is a drawing showing a simulation result of the temperature fluctuation depending on heat conductivity of the heat accumulating member 101 and the heating member 102 of the heating device 100 (No. 9).

FIGS. 10A through 12B show the simulation results of the temperature fluctuation at each part of the heating device 100 when the thickness of the heating member 102 is 0.5 times, 0.25 times, 0.1 times, 0.05 times, 0.01 times, and 10 times the 6.28 mm reference length, respectively, and then the information on the recording card 70 is erased by the heating member 102 of the heating device 100. FIGS. 13A and 13B show the simulation results of the temperature fluctuation at each part of the heating device 100 when the thickness of the heat accumulating member 101 is 10 times and 0.1 times the 5.50 mm reference length, respectively, and the information on the recording card 70 is erased by the heating member 102 of the heating device 100. Curved lines S1, S2 and S3 indicate the temperature fluctuation of the heating member 102, the heat generating member 103, and the heat accumulating member 101, respectively. FIG. 14 shows the simulation result of the temperature fluctuation when a virtual material is used for the heat accumulating member 101 and the heating member 102 and the thickness of the heating member 102 is 0.1 times the reference length.

As illustrated by FIGS. 10A through 12B and the Table 2 below, the temperatures of the heating member 102 after 2 seconds have passed since the erasing process is started are apt to be decreased depending on the thickness of the heating member 102. In contrast, as illustrated by FIGS. 13A and 13B, the temperatures of the heating member 102 after 2 seconds are substantially the same (425 K) regardless of the thickness of the heat accumulating member 101.

TABLE 2

| THICKNESS | TEMPERATURE AFTER 2 SECONDS |
|---|---|
| 0.50 times (3.14 mm) | 422 K |
| 0.25 times (1.57 mm) | 417 K |
| 0.10 times (0.63 mm) | 415 K |
| 0.05 times (0.31 mm) | 410 K |
| 0.01 times (0.06 mm) | 402 K |
| 10.0 times (62.8 mm) | 428 K |

As a result, the temperature fluctuation of the heating device 100 is much more dependent on the thickness change of the heating member 102 than that of the heat accumulating member 101 and is little dependent on the thickness change of the heat accumulating member 101. Because of this feature, it is conceived that the heat accumulating member 101 contributes to avoiding the burnout of the heat generating member 103 by heat being transferred from the upper surface of the heat generating member 103. According to the embodiments of the present invention, the thickness of the heating member is 0.06 mm or more, preferably 0.3 mm or more when considering the temperature fluctuation of the external environment, and more preferably 0.6 mm or more.

Further, since the heating device 100 according to the embodiment of the present invention can evenly heat the recording surface of the recording card 70 regardless of the figure and the heat distribution of the resistor 105, it is possible to use a general-purpose resistor and an inexpensive resistor as well as an expensive resistor having an even temperature distribution over its heating effective area, thereby enabling the reduction of the cost of the device.

Still further, the heating device 100 according to the embodiment of the present invention includes the heat accumulating member 101, having the substantially the same heat capacity, provided so as to contact with the upper surface of the heat generating member 103. Because of this feature, even when high power is applied to the heat generating member when, for example, the printer 100 is being booted up and accordingly the temperature of the heating member 102 is increased rapidly from 25° C. room temperature to, for example, 75° C. as a stand-by temperature, substantially the same heat amounts are transferred to the upper and the lower surfaces. Therefore, it is possible to avoid damage due to overheating the heat generating member 103.

Still further, since the heat accumulating member 101 compensates the heat transferred from the heating member 102 when the recording card 70 is being heated, it is possible to reduce the temperature fluctuation of the heating surface of the heating member 102 when plural recording cards 70 are sequentially heated.

Still further, since the heating device 100 according to the embodiment of the present invention includes the heat accumulating member 101 and the heating member 102 which have high heat capacity and high heat conductivity, it is possible to reduce the temperature fluctuation of the heating surface of the heating member 102 and reduce the total power amount applied to the heating member 102 when plural recording cards 70 are sequentially heated.

Still further, in the erasing device 30 according to the embodiment of the present invention, the information recorded on the recording card 70 is erased by using the heating device 100. Therefore, it becomes possible to heat the recording card 70 evenly and also erase the recorded information evenly.

Still further, in the printer 10 according to the embodiment of the present invention, in the erasing device 30, the information recorded on the recording card 70 is erased by using the heating device 100. Therefore, the recorded information can be erased evenly. Also, in the recording device 50, since information is recorded on the recording card 70 whose recorded information has been already erased evenly, it is possible to record the information accurately.

In the embodiment, a case where information is erased with respect to the recording card 70 in the printer 10 is described. However, it should be noted that the present invention is not limited to the above-mentioned embodiment. Any other thermosensitive recording paper may be used for erasing and recording information.

Further, the thermosensitive characteristics shown in FIG. 3 represent merely one example of the recording card 70; therefore the recording card 70 may have any other thermosensitive characteristics. In such a case, it is possible to operate with the thermosensitive characteristics by appropriately adjusting the heating temperatures in the erasing device 30 and the recording device 50.

Though aluminum is used as the material of the heat accumulating member 101 and the heating member 102 in the embodiment of the present invention, it should be noted that any other metal material, such as copper, having high heat conductivity may be used.

FIGS. 15A through 19 show the simulation results of the temperature fluctuation at each part of the heating member 100 when the materials of the heat accumulating member 101 and the heating member 102 are copper with the heat conductivity of 396 W/(m*° C.), aluminum of 237 W/(m*° C.), aluminum of 120 W/(m*° C.), ferrum of 80 W/(m*° C.), annealed copper of 52 W/(m*° C.), aluminum of 33 W/(m*° C.), a virtual material of 10 W/(m*° C.), a virtual material of 1 W/(m*° C.), and resin of 0.18 W/(m*° C.), respectively and the information on the recording card 70 is being erased. As illustrated by FIGS. 15A through 19 and Table 3 below, the temperature of the heating member 102 after 2 seconds have passed since erasing operation is started depends on the value of heat conductivity of the material.

TABLE 3

| MATARIAL | TEMPERATURE AFTER 2 SECONDS |
|---|---|
| copper with the heat conductivity of 396 W/(m * ° C.) | 429 K |
| aluminum of 237 W/(m * ° C.) | 425 K |
| aluminum of 120 W/(m * ° C.) | 422 K |
| ferrum of 80 W/(m * ° C.) | 422 K |
| annealed copper of 52 W/(m * ° C.) | 417 K |
| aluminum of 33 W/(m * ° C.) | 408 K |
| a virtual material of 10 W/(m * ° C.) | 380 K |
| a virtual material of 1 W/(m * ° C.) | 330 K |
| resin of 0.18 W/(m * ° C.) | 310 K |

As Table 3 shows, a material having heat conductivity equal to or more than 30 W/(m*° C.) can be used for the heat accumulating member 101 and the heating member 102 because the temperature after 2 seconds have passed since an erasing operation is started is equal to or more than 403 K. Further when considering the temperature fluctuation in the external environment, it is preferable to use a material having heat conductivity equal to or more than 50 W/(m*° C.). Specifically, the material to be preferably used includes diamond having heat conductivity of approximately 2000 W/(m*° C.) besides the above-mentioned aluminum and annealed copper.

Also when the material of the recording medium to be recorded is hard, the heated surface may be, for example, nickel-plated to improve the wear resistance of the surface.

Further, though the sheet-shaped heat generating member is used as the heat generating member 103 in the embodiment of the present invention, the present invention is not limited to the sheet-shaped heat generating member and any other configuration such as a resistor with an insulation film, such as an oxide film, formed on the surface of the resistor may be cast into and integrated into the heat generating member 103.

Figure 6:
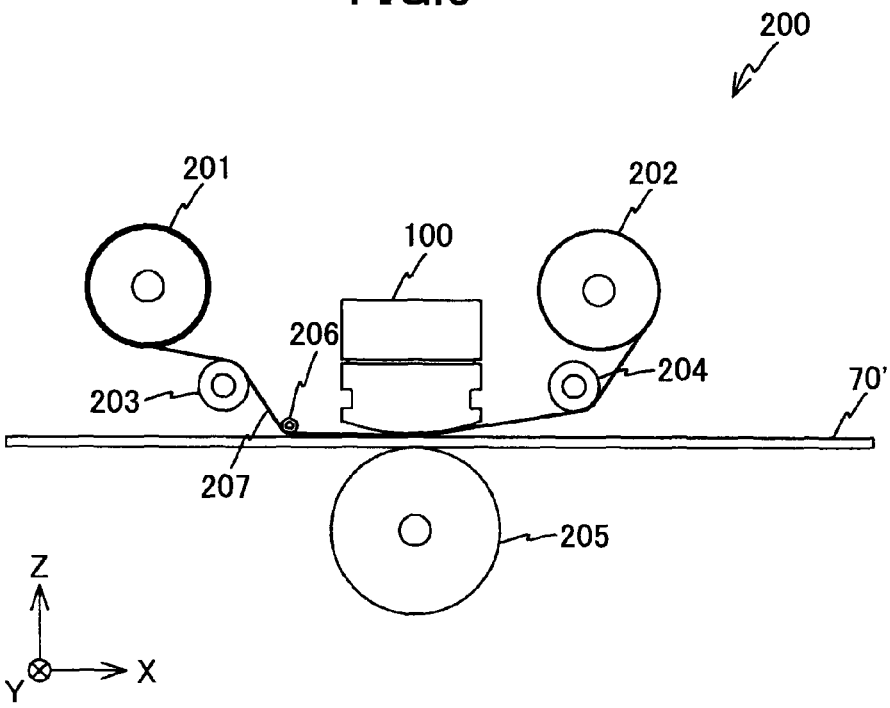
FIG. 6 is a drawing showing a transfer device 200 employing the heating device 100.

Still further, though the heating device 100 is used as an erasing head in the printer 10 according to the embodiment of the present invention, the present invention is not limited to the embodiment and is suited for any application in which a thermal medium having thermosensitive characteristics is evenly heated. As one example, FIG. 6 shows a transfer device 200 transferring the ink applied to an ink ribbon 207 to a recording medium 70'. In the transfer device 200, the recording medium 70' is moved relative to the heating device 100 by a platen roller 205, the ink ribbon 207 wound in a supply-side ribbon core 201 is supplied to the upper surface of the recording medium 70' by jointly rotating a pair of auxiliary rollers 203 and 204, a guide roller 206, and a rewind-side ribbon core 202. Then the upper surface of the ink ribbon 207 provided on the upper surface of the recording medium 70' is heated by the heating device 100. Because of this feature, the ink applied to the lower surface of the ink ribbon 207 is transferred to the upper surface of the recording medium 70'. In this manner, the heating device 100 according to the present invention can be used not only for a device for erasing the information recorded on a thermal recording medium but also for a device including a transfer device, transferring a coating agent such as ink to a recording medium, and a laminator.

As described above, the heating device according to the present invention is adapted to heat a thermal recording medium. Further, an information recording and erasing device according to the present invention is adapted to erase the information recorded on a thermally-reversible thermal recording medium. Still further, a transfer device according to the present invention is adapted to perform thermal transfer of a coating agent to an object.

The present invention is not limited to the above-mentioned embodiments, and variations and modifications may be made without departing from the scope of the present invention.

The present application is based on and claims the benefit of priority of Japanese Patent Application No. 2006-244324, filed on Sep. 8, 2006 and Japanese Patent Application No. 2007-162415, filed on Jun. 20, 2007, the entire contents of which are hereby incorporated by reference.

What is claimed is:

1. A heating device heating a thermal medium by heat energy converted from electric energy, comprising:

a heat generating member, with a surface thereof coated with an electrical insulator, converting the electric energy to the heat energy;

a heating member substantially evenly conducting the heat energy from the heat generating member; and a heat accumulating member, being in contact with and disposed on the surface of the other side of the heat generating member, accumulating the heat energy from the heat generating member, wherein the heat generating member is a sheet-shaped heat generating member, the heating member is in contact with and disposed on the surface of one side of the heat generating member, and heat conductivity of the accumulating member is ranged between 30 W/(m*° C.) and 200 W/(m*° C.).

2. An erasing device erasing information recorded on a thermal recording medium thermally reversibly colored and decolored, the device comprising:

the heating device according to claim 1 arranged to heat the thermal recording medium to erase the information; and a platen roller moving the thermal recording medium relative to the heating device.

3. An information recording and erasing device recording information to and erasing information on a thermal recording medium thermally reversibly colored and decolored, the device comprising:

the erasing device according to claim 2 arranged to heat the thermal recording medium to erase the information recorded on the thermal recording medium; and a recording device recording information on the thermal recording medium whose information has been erased by the erasing device.

4. A transfer device transferring a coating agent applied to the surface of one side of an ink ribbon to an object, the device comprising:

the heating device according to claim 1 arranged to heat the surface of the other side of the ink ribbon to transfer the coating agent to the object; and a platen roller, while pressing the object to the ink ribbon, moving the object relative to the heating device.

5. A heating device heating a thermal medium by heat energy converted from electric energy, comprising:

a heat generating member, with a surface thereof coated with an electrical insulator, converting the electric energy to the heat energy;

a heating member substantially evenly conducting the heat energy from the heat generating member; and a heat accumulating member, being in contact with and disposed on the surface of the other side of the heat generating member, accumulating the heat energy from the heat generating member, wherein the heat generating member is a sheet-shaped heat generating member, the heating member is in contact with and disposed on the surface of one side of the heat generating member, and at least one of the heat capacity and the heat conductivity of the heating member is substantially equal to the heat capacity and the heat conductivity, respectively, of the heat accumulating member.

6. The heating device according to claim 5, wherein a protection layer is formed on a surface of the heating member facing the thermal medium.

7. An erasing device erasing information recorded on a thermal recording medium thermally reversibly colored and decolored, the device comprising:

the heating device according to claim 5 arranged to heat the thermal recording medium to erase the information; and a platen roller moving the thermal recording medium relative to the heating device.

8. An information recording and erasing device recording information to and erasing information on a thermal recording medium thermally reversibly colored and decolored, the device comprising:

the erasing device according to claim 7 arranged to heat the thermal recording medium to erase the information recorded on the thermal recording medium; and a recording device recording information on the thermal recording medium whose information has been erased by the erasing device.

9. A transfer device transferring a coating agent applied to the surface of one side of an ink ribbon to an object, the device comprising:

the heating device according to claim 5 arranged to heat the surface of the other side of the ink ribbon to transfer the coating agent to the object; and a platen roller, while pressing the object to the ink ribbon, moving the object relative to the heating device.

10. A heating device heating a thermal medium by heat energy converted from electric energy, comprising:

a heat generating member, with a surface thereof coated with an electrical insulator, converting the electric energy to the heat energy;

a heating member substantially evenly conducting the heat energy from the heat generating member; and a protection layer formed on a surface of the heating member facing the thermal medium, wherein the heat generating member is a sheet-shaped heat generating member, the heating member is in contact with and disposed on the surface of one side of the heat generating member, and the area of the surface where the heating member is in contact with the sheet-shaped heat generating member is equal to or more than an effective heat generating area on the surface of the one side of the sheet-shaped heat generating member and is equal to or less than four times the effective heat generating area on the surface of the one side of the sheet-shaped heat generating member.

11. An erasing device erasing information recorded on a thermal recording medium thermally reversibly colored and decolored, the device comprising:

the heating device according to claim 10 arranged to heat the thermal recording medium to erase the information; and a platen roller moving the thermal recording medium relative to the heating device.

12. An information recording and erasing device recording information to and erasing information on a thermal recording medium thermally reversibly colored and decolored, the device comprising:

the erasing device according to claim 11 arranged to heat the thermal recording medium to erase the information recorded on the thermal recording medium; and a recording device recording information on the thermal recording medium whose information has been erased by the erasing device.

13. A transfer device transferring a coating agent applied to the surface of one side of an ink ribbon to an object, the device comprising:

the heating device according to claim 10 arranged to heat the surface of the other side of the ink ribbon to transfer the coating agent to the object; and a platen roller, while pressing the object to the ink ribbon, moving the object relative to the heating device.

* * * * *